US007543420B2

(12) United States Patent
Holt

(10) Patent No.: US 7,543,420 B2
(45) **Date of Patent: *Jun. 9, 2009**

(54) CONSTRUCTION CLIP

(75) Inventor: Lawrence Ray Holt, Salt Lake City, UT (US)

(73) Assignee: Trico Masonry Products, LLC, Eden, UT (US)

( * ) Notice: Subject to any disclaimer, the term of this patent is extended or adjusted under 35 U.S.C. 154(b) by 604 days.

This patent is subject to a terminal disclaimer.

(21) Appl. No.: 11/094,992

(22) Filed: Mar. 31, 2005

(65) Prior Publication Data

US 2006/0225373 A1 Oct. 12, 2006

(51) Int. Cl.
*E04B 1/38* (2006.01)

(52) U.S. Cl. ..... 52/698; 52/285.3; 52/262

(58) Field of Classification Search ..... 52/272, 52/285.3, 712, 293.3, 262, 271, 98, 100; 403/232.1, 286, 391, 174
See application file for complete search history.

(56) References Cited

U.S. PATENT DOCUMENTS 3,293,819 A * 12/1966 Heirich ..... 52/478
4,073,108 A * 2/1978 Williams ..... 52/238.1
4,712,942 A * 12/1987 Brown ..... 403/174
4,787,184 A 11/1988 Boidron
5,161,909 A * 11/1992 Crouse et al. ..... 403/391
5,918,427 A 7/1999 VanderWerf
6,298,555 B1 * 10/2001 Vincenti ..... 29/890.14
6,691,471 B2 * 2/2004 Price ..... 52/169.12
7,299,597 B2 11/2007 Holt
2006/0225373 A1 * 10/2006 Holt ..... 52/285.3

FOREIGN PATENT DOCUMENTS

WO WO 2006/105327 10/2006

OTHER PUBLICATIONS

U.S. Appl. No. 11/238,797, mailed Feb. 13, 2007, Office Action.
U.S. Appl. No. 11/238,797, mailed Jul. 16, 2007, Notice of Allowance.

* cited by examiner

*Primary Examiner*—Basil Katcheves
(74) *Attorney, Agent, or Firm*—Workman Nydegger

(57) ABSTRACT

A clip for securing metal plates in walls constructed using masonry blocks. The clip includes a plate portion and a block portion. The block portion has members that form an opening that fits over a member of a masonry block. The plate portion also has members that form an opening that receives and secures a metal plate. When the block portion is placed on the member of a masonry block, the clip holds a metal plate in a fixed position relative to the masonry block. The clip can include notches on an edge of one of the members to more securely hold the clip on the masonry block.

17 Claims, 4 Drawing Sheets

CONSTRUCTION CLIP

CROSS-REFERENCE TO RELATED APPLICATIONS

Not applicable.

BACKGROUND OF THE INVENTION

1. The Field of the Invention

The present invention relates to construction. More particularly, embodiments of the invention relate to a construction clip used in the construction of concrete block structures.

2. The Relevant Technology

Cinder or concrete blocks are examples of materials that are frequently used in various construction projects. When a wall, for example, is constructed using concrete blocks, it is often necessary to insert metal plates into the wall at various locations. After the metal plates are inserted into the wall, an angle iron may be welded to the metal plates and used to support another structure such as a ceiling or an overhang.

Inserting the metal plates into the concrete block wall, however, presents several difficulties to construction workers and has an economic cost at least in terms of time. As a basic rule, the metal plates should be flush with the wall surface such that the angle iron can be successfully welded to the metal plates. This requires the metal plates to be properly positioned. The issue faced by construction workers, is ensuring that the metal plates can be properly positioned and then kept in that position until the plates can be permanently secured in place. In other words, the initial insertion of the metal plates is not permanent until other steps are completed. There is therefore a need to temporarily hold the metal plates in the proper position until they are permanently secured in position.

For example, securing the metal plates often requires the use of grout, but the plates need to be held in place until the grout can be added and cured. The concrete blocks may be filled with grout that is used to permanently secure the metal plates in the wall. When the grout is added, however, a vibrator is often used to remove air pockets and the like. The vibrations often have the detrimental effect of knocking out the metal plates. In addition, the pressure of the grout alone can cause the metal plates to become displaced.

Conventionally, wooden wedges are used to secure the metal plates in the concrete block wall while the grout is added and vibrated and often until the grout cures. Wooden wedges, however, are not efficient for many reasons. First, inserting the wooden wedges takes a substantial amount of time in order to insure that the metal plate is properly secured. Even then, the vibrator or the pressure of the grout can cause the metal plates to dislodge. Second, the time it takes to secure the metal plates with conventional wedges has an economic cost as it slows the masonry effort. There is therefore a need for systems and methods that for inserting metal plates into concrete block walls.

BRIEF SUMMARY OF THE INVENTION

These and other limitations are overcome by embodiments of the invention, which relate to a clip. The clip can be used in construction projects, by way of example, that use masonry blocks such as cinder blocks or concrete blocks to build walls. In certain portions of these walls, metal plates are inserted and used to support another structure.

Each clip can be used to hold a metal plate in a fixed position or location relative to a masonry block until the metal plate is permanently attached. The clip includes a block portion that fits onto a member of the masonry block. The members of the block portion have a width that is substantially equal to a width of the member of the masonry block.

At least one of the members may have an edge with notches, which represent curves protrusions and the like, that enable the block portion to prevent the block portion from slipping on the block or to more securely grasp the block. In addition, the members of the block portion can be expanded or contracted to alter a width between the two members. Thus, one or both members may be flexible yet still retain a sufficient rigidity such that the metal plate is held in a fixed location.

The plate portion also has a pair of members that form an opening that receives a metal plate. These width separated these members can also be expanded or retracted by bending or flexing the members as needed to hold the metal plate securely. Each metal plate can be held in position using, for example a clip on the bottom of the plate and a clip on the top of the plate.

One member of the plate portion and one member of the block portion form a substantially flat surface that is usually flat against the wall. The plate is typically held in a fixed location such that a surface of the plate is flush with the surface of the wall. This enables an angle iron or other metal to be securely fixed to the metal plates that are inserted into the walls using one or more clips.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to construction clips and more particularly to construction clips used to hold metal plates in a fixed location relative to masonry blocks used in construction situations. Typically, the clips hold the metal plates in position until the metal plates are permanently fixed in position. The principles of the present invention are described with reference to the attached drawings to illustrate the structure and operation of example embodiments used to implement the present invention. Using the diagrams and description in this manner to present the invention should not be construed as limiting its scope. Additional features and advantages of the invention will in part be obvious from the description, including the claims, or may be learned by the practice of the invention. Detailed descriptions of well-known components and other construction techniques are omitted so as not to unnecessarily obscure the invention in detail. Further, the drawings are not necessarily drawn to scale.

Figure 1:
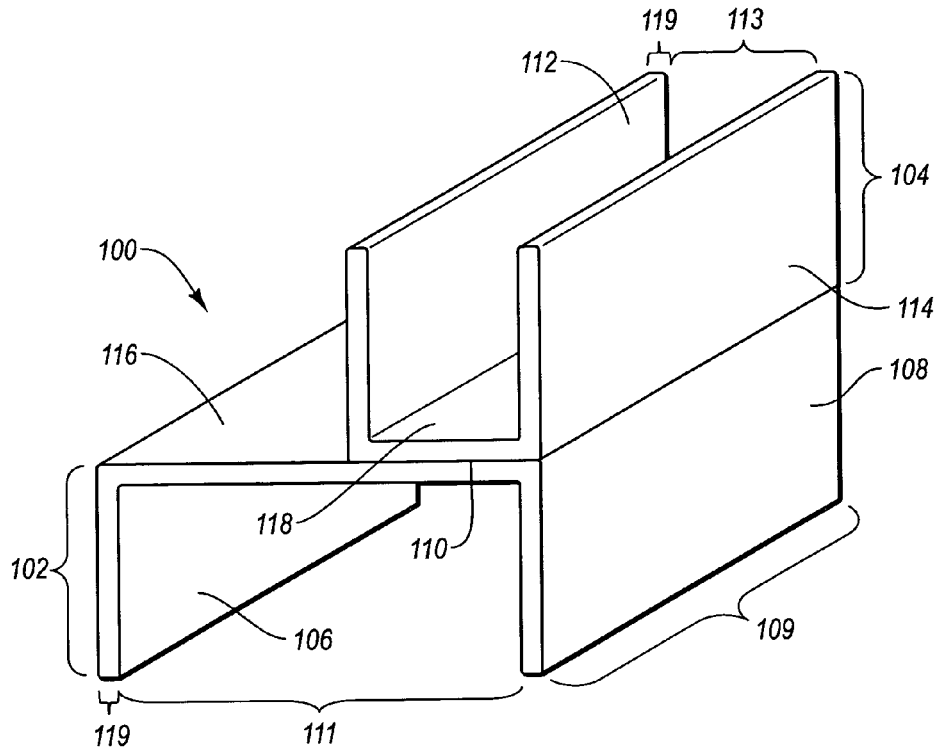
FIG. 1 illustrates a perspective view of one embodiment of a construction clip.

FIG. 1 illustrates a perspective view of one embodiment of a construction clip 100. The clip 100 can be used in construction to hold a metal plate in a particular location relative to other masonry blocks in a wall, for example, as the wall is constructed. In this example, the clip 100 and in particular the block portion 102 can fit over a portion or a member of a masonry block (such as a cinder block, a concrete block, or other masonry block or brick). A plate portion 104 receives bottom of a metal plate. As the next few rows of the wall are built, another clip may be used to hold the other member of the metal plate relative to another masonry block. In this manner, the plate is held in place by a pair of clips 100 and the need to used wedges to hold the metal plate in position is eliminated. Further, the construction of the wall can be performed at a faster pace as the use of a clip takes seconds while using wedges can consume significantly more time. Also, the metal plate is less likely to become displaced from the wall when the grout is added, or when a vibrator is used to settle the grout, for example.

In this example, the clip 100 includes a block portion 102 and a plate portion 104. The block portion 102 and the plate portion 104 can be made of metal and then bonded or welded together at location 110. Alternatively, the block portion 102 and the plate portion 104 can be molded from another material such as plastic. One of skill in the art can appreciate other adequate materials and other adequate methods of securing the block portion 102 to the plate portion 104.

The block portion 102 includes a member 106, a base 116, and a member 108. The members 106 and 108 along with the base 116 form a U shaped opening that has a width 111 between the members 106 and 108. The plate portion 104 includes a member 112, base 118 and a member 114. The members 112 and 114 along with the base 118 also form a U shaped opening that has a width 113 between the members 112 and 114. The widths 111 and 113 can be contracted or expanded by moving one or both members. Typically, the member 114 of the plate portion 104 and the member 108 of the block portion 102 should present a substantially flush surface or be substantially flat. Thus, the members 112 and 106 are usually adjusted to accommodate plates and blocks of varying widths.

In this example, the member 106 and the member 112 have some flexibility without losing the ability to securely hold a metal plate. In other words, even after adjusting one or both of the members 112 and 106, these members still have sufficient rigidity to insure that the metal plate is held in a fixed position relative to a masonry block. For example, the members 106 and/or 112 may be flexible and can be bent inwards or outwards to accommodate varying sized of concrete blocks and metal plates. Further, the ability to bend a member can enhance the ability of the clip 100 to secure a metal plate. The members of the plate portion and of the block portion can each create a friction fit. This can secure the clip to both the masonry block and the metal plate. In some instances, a tight fit of the metal plate in the opening of the plate portion is not required and the plate can fit loosely. This is because the members of the clip will prevent the plate from being displaced from the wall after subsequent rows are constructed. Advantageously, the clip 100 can hold the metal plate in position quickly and efficiently until the metal plate is permanently secured with grout.

The dimensions of the clip 100 can vary and may be related to a particular construction need. The block portion 102 and the plate portion 114 may each have a length 109 between ⅛ inch to 9 inches. The width 113 of the plate portion 104 may be, by way of example, ¾ inches and the width 111 of the block portion 102 may be 1 and ¾ inches. The thickness 119 of the block portion 102 and the plate portion 104 can be, by way of example, ⅛ inch. One of skill in the art can appreciate that the clip 100 is not limited to these dimensions and that they are provided by way of example only. Further, the dimensions of the plate portion 104 do not have to be the same as the dimensions of the block portion 102. For example, the length of the plate portion 104 can be shorter or longer than a length of the block portion 102.

Figure 2:
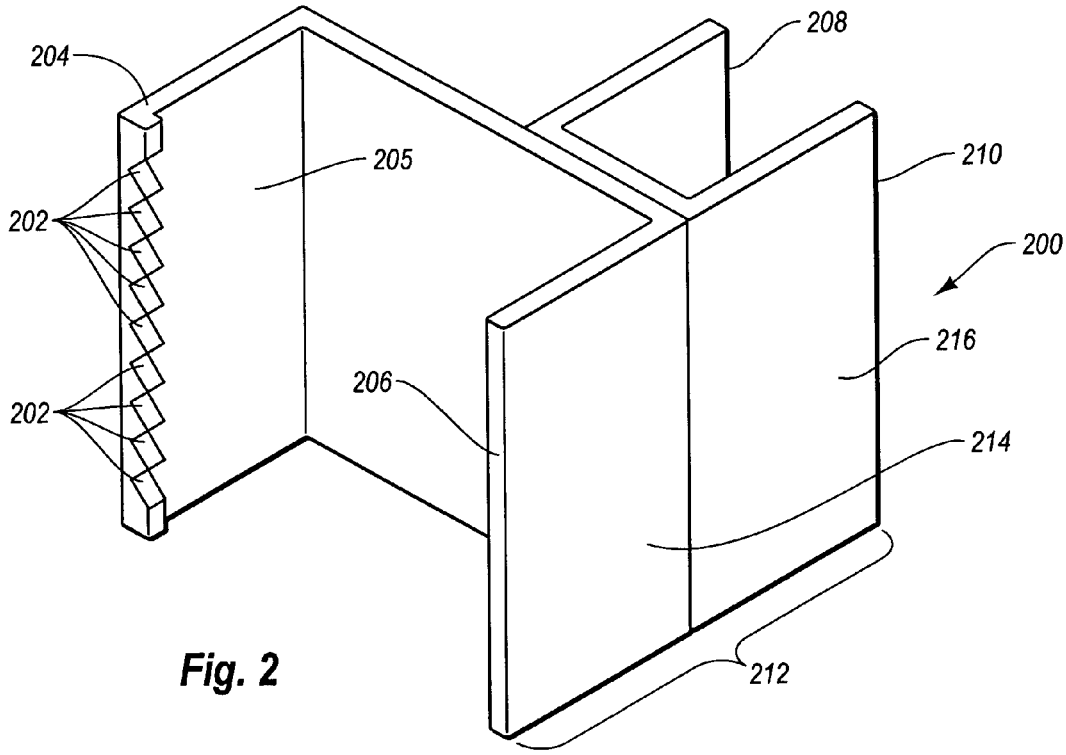
FIG. 2 illustrates another perspective view of another embodiment of a construction clip.
Figure 5:
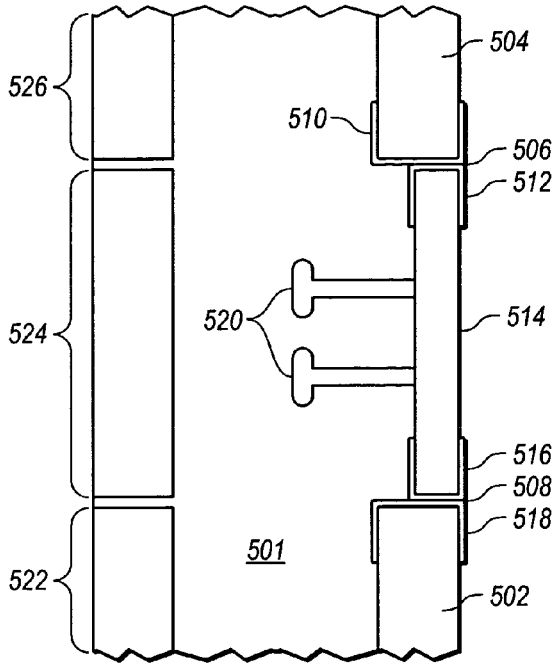
FIG. 5 is a member view of a metal plate built into a concrete block wall and secured using construction clips.

FIG. 2 illustrates a perspective view of another embodiment of a construction clip 200. In this example, the clip includes a plate portion 216 that is securely connected with the block portion 214. The surface 212 is substantially flat as previously described and, when the clip is used in constructing a wall, the surface 212 is typically flat against the surface of the wall. The surface 212 is considered to be substantially flat even when the corresponding members on the block portion and the plate portion are not perfectly aligned. In other words, the members of the block portion and the plate portion that make up the surface 212 may be offset. In certain situations, it may be desirable to have an offset. In some embodiments, these members do not form a substantially flat surface, but are offset. The offset can be determined by particular use. In this case, an edge 204 of the member 205 has notches 202 formed therein. The notches 202 enable the block portion 214 to more securely grasp a concrete block as illustrated in FIG. 5, for example. The notches can be pointed or rounded. The notches 202 are intended to represent any type of protrusion, rib, or ridge that can be formed to provide an edge that more securely grasps a masonry block. The notches 202 can enhance the ability of the clip 100 to connect with a masonry block when the clip is placed onto a member of the masonry block.

The edges 208, 210, and 206 do not include notches 202 in this example, but these edges are not precluded from having notches. In one embodiment, the edges 210 and 206 do not have notches in order to ensure that the surface 212 is substantially flat. This enables a front surface of the metal plate to be substantially flush with the wall surface. Notches or ridges on the edge 210 can result in the metal plate being inset from a surface of the wall. An inset plate cannot be easily secured to an angle iron, as discussed below with reference to FIG. 6.

Figure 3:
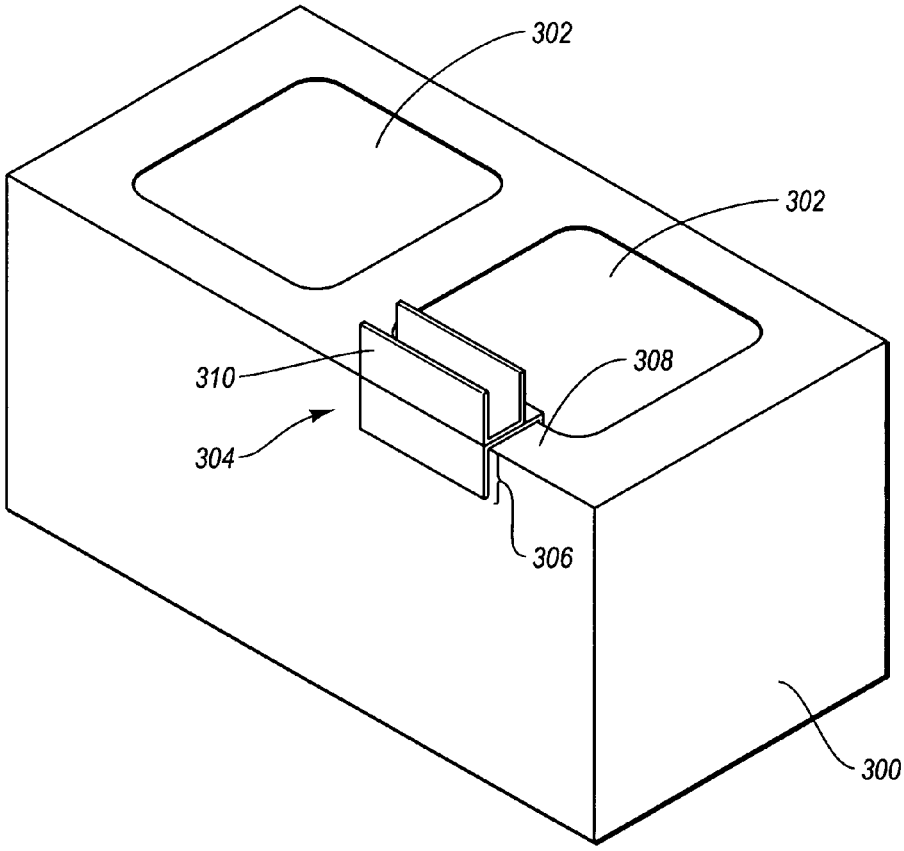
FIG. 3 illustrates a construction clip mounted on a concrete block.

FIG. 3 illustrates a construction clip 304 that is mounted on a masonry block such as the cinder block 300. A cinder block 300 often has openings 302 formed therein. The block portion 306 of the clip 304 fits over the edge 308 of a member of the cinder block 300. When the clip 304 is placed in this position, the plate portion 310 is ready to receive a metal plate in the U shaped opening formed by the members of the plate portion. When the clip 304 is placed on the side or edge 308 of the cinder block 300, the member of the block portion within the opening 302 can be moved to more securely attach the clip 304 to the block 300. Alternatively, the width between the members of the block portion 306 of the clip 304 can be adjusted such that some force is required to push the clip 304 onto the side or edge 308 of the block 300. As previously discussed, an edge of the member inside the opening 302 may have notches to provide a firmer grasp on the block 300.

Figure 4:
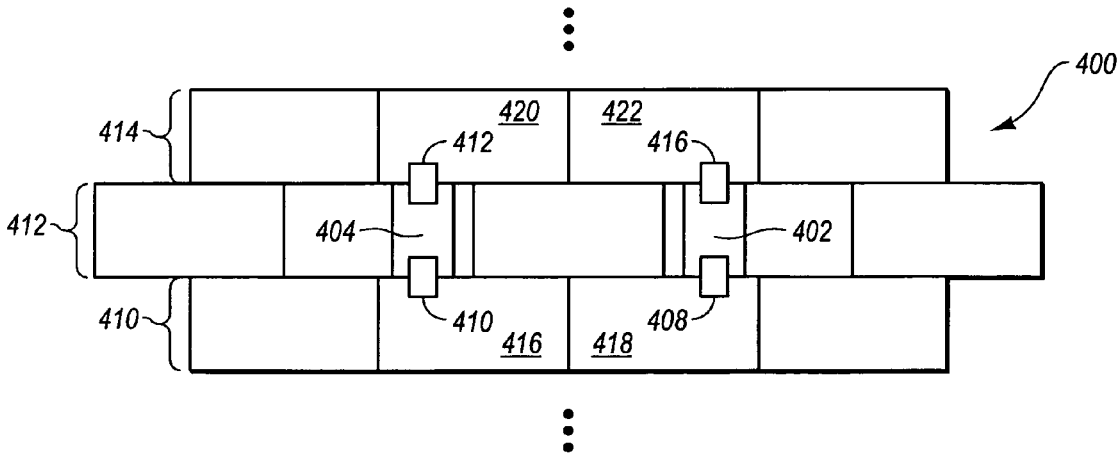
FIG. 4 illustrates a concrete block wall that included metal plates held in place by construction clips.

As the wall is built using cinder blocks, and as illustrated in FIG. 4, the metal plates 404 and 402 can then be securely held in a wall 400 in a fixed location relative to surrounding masonry blocks. In this example, the plate 404 is held by the clips 410 and 412 in a fixed location relative to surrounding masonry blocks while the plate 402 is held by the clips 406 and 408 in a fixed location relative to surrounding masonry blocks.

During construction of the wall 400, the row 410 is built and the clips 410 and 408 are placed respectively on sides or edges of the blocks 416 and 418 as illustrated in FIG. 3. Next, the row 412 is constructed and a space is left open for the plates 404 and 402. This can be achieved by cutting the masonry blocks or by leaving a space for the metal plates.

Next, the row 414 is built on top of the row 412. At this point, the metal plates are inserted into the plate portions of the clips 410 and 408. Then the plate portions of the clips 412 and 406 are placed on the top members of the metal plates 404 and 402. Finally, the blocks 420 and 422 are placed and received into the U shaped openings of the block portions of the clips 420 and 422. Once this is done, the plates 404 and 402 are held in place. The clips typically hold the metal plates in a manner such that the metal plates are flush with the wall 400.

FIG. 5 illustrates a member view of a wall that includes a metal plate secured with construction clips. FIG. 5 illustrates three blocks 526, 524, and 522 that are part of a wall. The plate 514 has been inserted into the wall and part of the block 524 has been removed to accommodate the plate 514. In this example, the clip 518 is used to secure a bottom portion of the plate 514. The plate portion 516 receives the bottom of the plate 514 while the block portion 518 of the clip 508 is placed over the member 502 of the block 522.

The clip 506 is similarly positioned. The plate portion 512 is placed onto the top portion of the plate 514 and the block portion 504 of the clip 506 receives the member 504 of the block 526. Once the block 526 is in position, the plate 514 is unlikely to move and is held in place by the clips 506 and 508.

The clips 506 and 508 also hold the plate 514 in the correct position with respect to the wall. Thus, the front surface of the plate 514 is properly positioned in the wall and is, in one example, flush with the surface of the wall. The clips can improve the speed with which the wall is constructed because placing the clips onto the blocks requires a minimal amount of time, as opposed to trying to properly position the plate 514 using wedges.

In this example, the interior space 501 may be filled, for example, grout. The plate extensions 520 are then surrounded by the grout. When the grout cures, the plate 514 is permanently inserted into the wall. As previously stated, a vibrator may be used to eliminate air bubbles from the grout. The clips 508 and 506, however, prevent the plate 514 from being displaced during vibration or by the pressure exerted by the grout.

Figure 6:
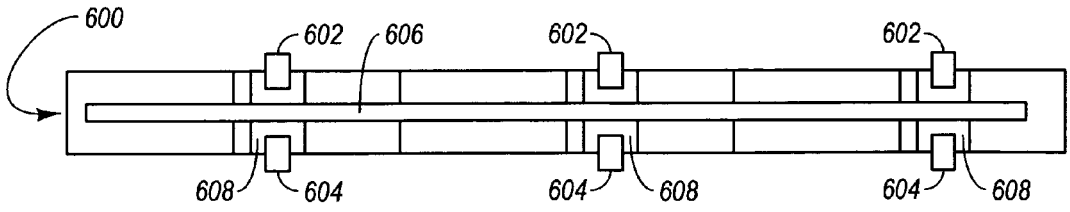
FIG. 6 illustrates an iron securely connected to one or more metal plates mounted in a wall.

In many situations, there is no need to remove the clips. As illustrated in FIG. 6, an angle iron 606 or other metal may be welded to the metal plates 608 that are in the row 600 of cinder or concrete blocks. The clips 604 and 602 do not interfere with the ability to weld the iron 606 to the plates 608. In situations where the iron 606 covers the clips 604, the clips 604 typically burn away during the welding process. In this example, the clips 602 and 604 have properly positioned the plates 608 such that the iron 606 can be mounted against the row 600.

Figure 7:
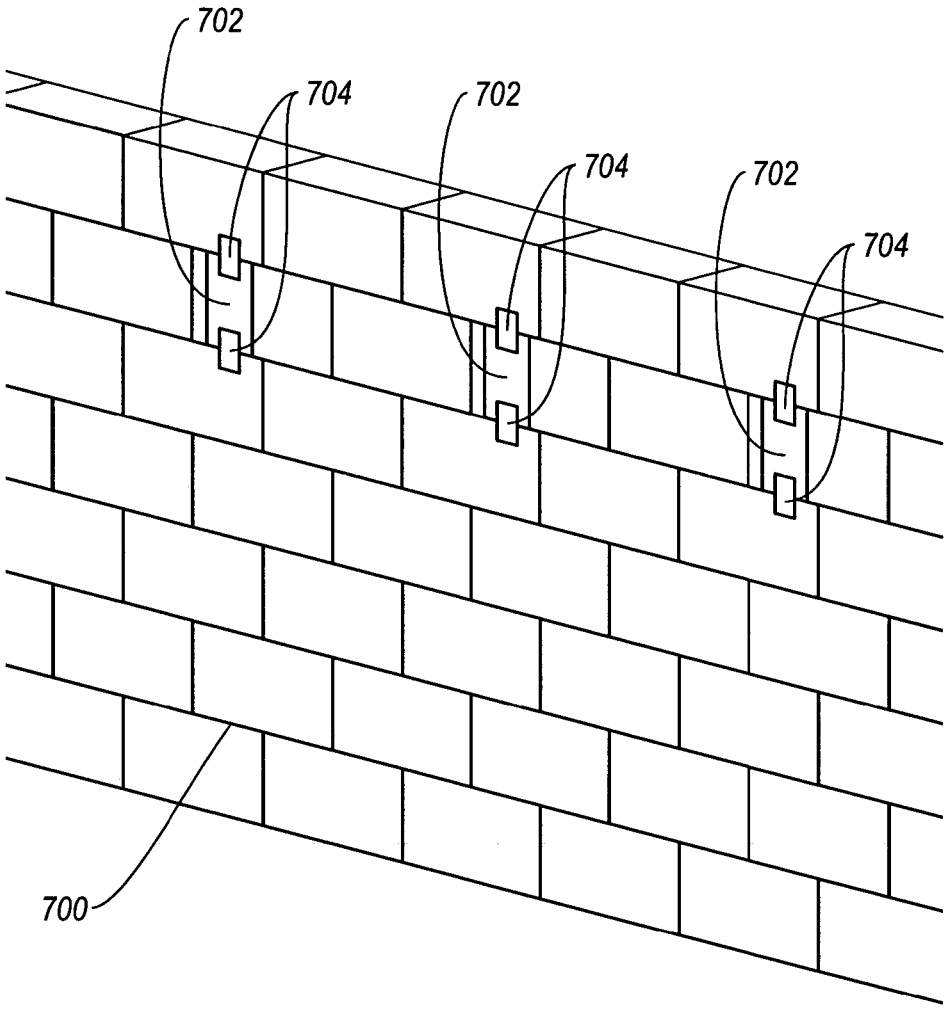
FIG. 7 illustrates another example of metal plates inserted into a wall using embodiments of a construction clip.

FIG. 7 illustrates another example of a construction project. This project includes a wall 700 that includes multiple plates 702 inserted or included in the wall 700. The plates 702 are secured by the clips 704.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. In a construction environment, a method of securing metal plates in a wall constructed with blocks, the method comprising:

providing a block for constructing the wall;

fitting a clip over a portion of the block, the clip comprising:

at least one base;

a first member extending out from the at least one base in a first direction;

a second member extending out from the at least one base in a second direction such that the first member and the second member form a substantially planar surface;

a third member extending out from the at least one base and forming a first opening with the first member, wherein the first opening is adapted to receive and hold a metal plate;

a fourth member extending out from the at least one base and forming a second opening with the second member, wherein the second opening fits over a portion of the block; and placing a metal plate into the first opening of the clip, such that the metal plate is held in a fixed location relative to the block.

2. A method as defined in claim 1, wherein the fourth member of the clip further comprises an edge that is substantially flat.

3. A method as defined in claim 1, wherein the fourth member of the clip further comprises an edge that has one or more notches or curves.

4. A method as defined in claim 1, wherein the base, the first member, the second member, the third member, and the fourth member of the clip each comprise metal.

5. A method as defined in claim 1, wherein the base, the first member, the second member, the third member, and the fourth member each comprise plastic.

6. A method as defined in claim 1, wherein the first member of the clip has a length that is equal to a length of second member.

7. A method as defined in claim 6, wherein the first opening of the clip has a width that is less than a width of the second opening of the clip.

8. A method as defined in claim 6, wherein the first member of the clip and the second member of the clip form a substantially flat surface.

9. A method as defined in claim 6, wherein the fourth member of the clip is flexible.

10. A system for building a brick wall, the system comprising:

a block made from the group of concrete, ceramic, natural stone, or mixtures thereof;

a clip comprising:

a plate portion formed on a first portion of the clip, the plate portion having a base, a first end of the base including a first member and a second end of the base including a second member, wherein the first member and the second member form an opening that receives a metal plate such that metal plate is held within the plate portion by the first member and the second member; and a block portion formed on a second portion of the clip, the block portion comprising a first member and a second member separated by the base, wherein the first member and the second member form an opening that receives a member of a block such that plate portion holds the metal plate is a secure location relative to the block;

wherein the first member of the plate portion and the first member of the block portion further comprise a substantially flat surface; and a metal plate which is capable of being received by the plate portion of the clip such that the plate portion holds the metal plate in a secure position relative to the block.

11. The system as defined in claim 10, wherein the plate portion of the clip has a length that is the same as a length of the block portion of the clip.

12. The system as defined in claim 10, wherein the plate portion of the clip has a length that is different from a length of the block portion of the clip.

13. The system as defined in claim 10, wherein a width between the first and second members of the plate portion of the clip is less than a width between the first and second members of the block portion of the clip.

14. The system as defined in claim 10, the first member of the block portion of the clip further comprising an edge, the edge having one or more notches that hold the block portion more securely on the member of the block.

15. The system as defined in claim 10, the block portion and the plate portion of the clip further comprising metal.

16. The system as defined in claim 10, the block portion and the plate portion of the clip further comprising plastic.

17. The system as defined in claim 10, wherein the first member of the block portion of the clip is flexible such that the block portion can hold one or more blocks each block having a different member width.

* * * * *